US011396805B2

(12) United States Patent
Erge et al.

(10) Patent No.: US 11,396,805 B2
(45) Date of Patent: Jul. 26, 2022

(54) METHOD AND SYSTEM FOR MONITORING AND CONTROLLING FLUID MOVEMENT THROUGH A WELLBORE

(71) Applicant: Schlumberger Technology Corporation, Sugar Land, TX (US)

(72) Inventors: Oney Erge, Houston, TX (US); Ginger Vinyard Hildebrand, Houston, TX (US); Wayne Kotovsky, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/721,920

(22) Filed: Dec. 20, 2019

(65) Prior Publication Data

US 2020/0123893 A1 Apr. 23, 2020

Related U.S. Application Data

(63) Continuation of application No. 15/506,769, filed as application No. PCT/US2015/042900 on Jul. 30, 2015, now Pat. No. 10,519,764.

(60) Provisional application No. 62/043,341, filed on Aug. 28, 2014.

(51) Int. Cl.

| | |
|---|---|
| ***E21B 47/047*** | (2012.01) |
| ***E21B 33/13*** | (2006.01) |
| ***E21B 47/005*** | (2012.01) |
| ***E21B 33/14*** | (2006.01) |
| ***E21B 47/06*** | (2012.01) |
| *E21B 33/12* | (2006.01) |

(52) U.S. Cl.

CPC ..... *E21B 47/047* (2020.05); *E21B 33/13* (2013.01); *E21B 33/14* (2013.01); *E21B 47/005* (2020.05); *E21B 47/06* (2013.01); *E21B 33/12* (2013.01)

(58) Field of Classification Search

CPC ..... E21B 33/13; E21B 33/14; E21B 47/005; E21B 47/06; E21B 47/047

See application file for complete search history.

(56) References Cited

U.S. PATENT DOCUMENTS

| | | | |
|---|---|---|---|
| 4,571,993 | A | 2/1986 | Onge |
| 6,892,812 | B2 | 5/2005 | Niedemayr et al. |
| 6,904,981 | B2 | 6/2005 | van Riet |
| 8,606,734 | B2 | 12/2013 | du Castel et al. |

(Continued)

FOREIGN PATENT DOCUMENTS

| | | | |
|---|---|---|---|
| GB | 2532967 | A | 6/2016 |
| WO | 2016/061171 | A1 | 4/2016 |

OTHER PUBLICATIONS

Spoerker, "Real-Time Job Monitoring and Performance Control of Primary Cementing Operations as a Way to Total Quality Management," SPE Drilling and Completion, Dec. 1995, SPE 28310.

(Continued)

*Primary Examiner* — Caroline N Butcher
(74) *Attorney, Agent, or Firm* — Alec J. McGinn

(57) ABSTRACT

A method for moving fluid through a pipe in a wellbore includes placing at least two different fluids in the pipe and in an annular space between the pipe and the wellbore. Fluid is pumped into the pipe at a rate to achieve a desired set of conditions. Using a predetermined volume distribution of the annular space, an axial position of each of the at least two fluids in the annular space during the pumping the displacement fluid is calculated.

21 Claims, 8 Drawing Sheets

(56) References Cited

U.S. PATENT DOCUMENTS

| | | | | |
|---|---|---|---|---|
| 10,519,764 | B2 | 12/2019 | Erge et al. | |
| 2003/0196804 | A1* | 10/2003 | Riet | E21B 21/106 166/267 |
| 2005/0092523 | A1 | 5/2005 | McCaskill et al. | |
| 2008/0067116 | A1 | 3/2008 | Anderson et al. | |
| 2011/0166789 | A1 | 7/2011 | Barrow et al. | |
| 2013/0118752 | A1 | 5/2013 | Hannegan et al. | |
| 2014/0180592 | A1* | 6/2014 | Ravi | E21B 47/107 702/12 |
| 2015/0322775 | A1* | 11/2015 | Marland | E21B 47/06 702/12 |

OTHER PUBLICATIONS

Beruit, "The Phenomenon of Fee Fall During Primary Cementing," SPE 13045 Presented at 59th Annual Technocal Conference and Exhibition Sep. 16-19, 1984, Houston, TX.

International Search Report and Written Opinion for the counterpart International patent application PCT/US2015/042900 dated Nov. 10, 2015.

International Preliminary Report on Patentability for the counterpart International patent application PCT/US2015/042900 dated Mar. 9, 2017.

* cited by examiner

METHOD AND SYSTEM FOR MONITORING AND CONTROLLING FLUID MOVEMENT THROUGH A WELLBORE

CROSS-REFERENCE TO RELATED APPLICATIONS

This is a continuation application of co-pending U.S. patent application Ser. No. 15/506,769, filed on Feb. 27, 2017 under national phase of PCT/US2015/042900, file on Jul. 30, 2015, which claims priority to U.S. Provisional Patent Application Ser. No. 62/043,341, filed on Aug. 28, 2014, and entitled "Method and System for Monitoring and Controlling Fluid Movement through A Wellbore," and is incorporated herein by reference in its entirety.

BACKGROUND

This disclosure is related to the field of pumping fluid through a pipe or conduit inserted into a wellbore drilled through subsurface formations. More specifically, the disclosure relates to methods for determining axial position of different fluids both within the conduit and an within annular space outside the conduit, and controlling movement of the fluids to avoid wellbore mechanical problems.

Pumping fluids through a subsurface wellbore includes using a pump disposed at the Earth's surface, or proximate the water surface for marine wellbores. Discharge of one or more selected types of fluid from the pump may be directed through a conduit or pipe disposed in the wellbore. The conduit may extend to the bottom (axially most distant from the surface end) of the wellbore. The pumped fluid moves through the interior of the pipe and may return through an annular space ("annulus") between the pipe and the interior wall of the wellbore.

During construction of a wellbore, it may be desirable in certain circumstances to move different types of fluid through the pipe and into the annulus. For example, a "sweep" or limited volume of high viscosity fluid may be moved through the annulus to assist in removing drill cuttings from the wellbore. Alternately, a "pill" or limited volume of fluid may be used for other purposes such as to stop circulation loss (i.e., loss of fluid from the annulus into exposed formations) or to free stuck drill string or other tubular element.

During the course of wellbore drilling, various additives may be mixed into the drilling fluid in order to address different specific requirements, e.g., a lubricant to reduce friction, to reduce stuck pipe tenancies and to increase drilling rate (ROP). Weighting materials may be added to increase the fluid density ("mud weight"). In cases when such materials are added to the pumped fluid, it is useful to know the placement within the wellbore at any time of the fluid having the additives in order to better manage dynamic drilling parameters.

During completion operations, a casing (a pipe extending from the well bottom to the surface) or liner (a pipe extending from the bottom of the well to a selected depth, usually proximate the bottom of a previously installed pipe or casing) may be cemented in place in the wellbore. Cementing operations including pumping several different types of fluid in succession, including cement. The cement is typically pumped so that it either fills the annulus completely or is pumped to a selected depth in the annulus, depending on the design of the wellbore.

Irrespective of the type of fluids being pumped, it is valuable for the drilling unit operator to have information concerning the axial position within the annulus of each of the pumped fluids, the flow rate and flow regime (laminar or turbulent) of each of the fluids at various locations, and the hydrodynamic pressure exerted by the fluids in the annulus. Knowing the hydrodynamic pressure may be important to prevent either fluid influx from any permeable formations exposed to the annulus if the hydrodynamic pressure falls below the fluid pressure in such formations, or fluid loss from the annulus if the hydrodynamic pressure exceeds the fracture pressure of any one or more formations.

The ability to optimize flow rate within a safe operating "envelope" (i.e., a set of limiting operating parameters) may enable the wellbore operator to avoid problems and to maximize performance during wellbore construction operations.

DETAILED DESCRIPTION

Methods according to the various aspects of the present disclosure may be implemented on a computer system or multiple computer systems. Such computer system or systems may be in signal communication with one or more user interfaces. A user interface may include a user display and an input device. In some embodiments, the user display and input device may be combined into a single device. Example embodiments of a computer system will be further explained with reference to FIG. 8.

Figure 1:
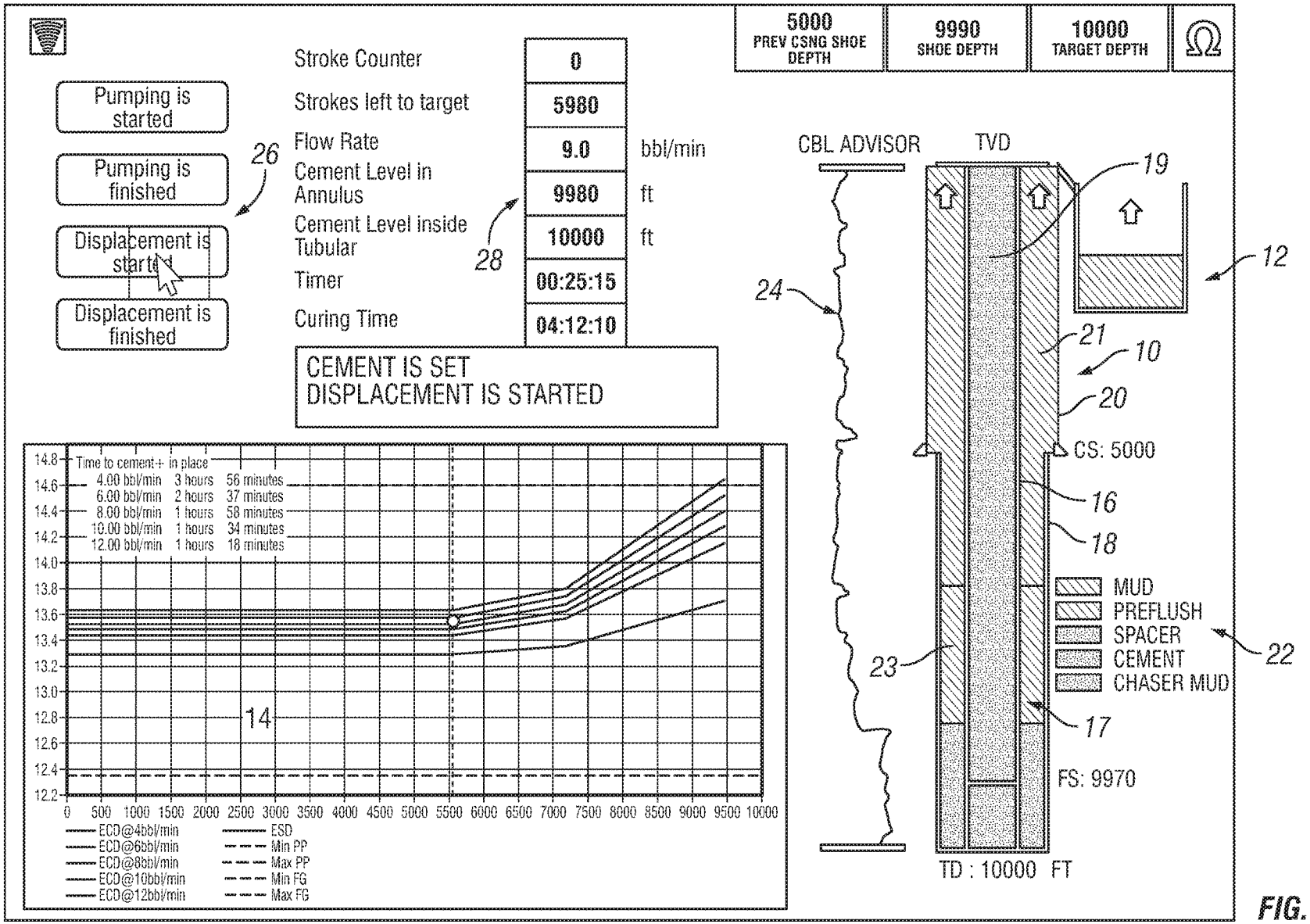
FIG. 1 shows an example display screen indicating components of a wellbore, a graph of equivalent dynamic fluid densities with respect to depth and user selectable controls for monitoring and controlling fluid movement. The display screen may represent fluid placement and conditions at the start of fluid movement.

FIG. 1 shows an example visual display that may be generated by a computer or computer system (FIG. 8) and displayed on a computer display screen. The computer display screen may be a passive computer display or it may include user input capability (e.g., a "touch screen"). An example of a touch screen and associated computer interface hardware such as a programmable logic controller (PLC) may be obtained from GE Intelligent Platforms, General Electric Company, Fairfield, Conn. The example visual display may show a cross sectional representation of a wellbore 10 including a pipe or conduit 16 extending through exposed, drilled formations (shown as an interior wellbore wall 18) to the bottom of the wellbore 10. The pipe 16 may be, for example, a casing or a liner. In the present example the pipe 16 is a casing. An annulus 17 between the pipe 16 and the drilled formations (i.e., wellbore wall 18) is to be filled with cement. A legend 22 may be displayed to indicate which graphic display type represents each of a plurality of different fluids present inside the pipe 16 and inside the annulus 17. The positions within the pipe 16 and the annulus 17 of each of the fluids represented in the legend 22 may be shown in the graphic display of the wellbore 10. In the present example, a surface or intermediate casing 20 has been previously cemented in place in the wellbore 10. It should be understood that for purposes of defining the scope of the present disclosure that the pipe 16 may be the only casing (or liner) in the wellbore in any particular fluid pumping operation. Further, there may be more than one already cemented in place casing (or liner) in addition to the casing 20 shown in the present example display. Fluid displaced from the annulus 17 may be directed to a tank, shown at 12 in the visual display.

The example graphic display shown in FIG. 1 may display, at 26, the present status of fluid pumping, and in embodiments in which a user input is provided, the status may be manually entered by the system user, e.g., using a touch screen if such is used in any particular embodiment. At 28, a display representing volume of fluid pumped, target volume of fluid to be pumped and time may be presented on the user display.

A graph 14 of equivalent dynamic fluid densities (equivalent circulating densities—ECD) of the fluids during pumping at various rates may be presented on the user display as shown. The ECD of each fluid may differ from the hydrostatic pressure (i.e., the pressure exerted by the fluid when the fluid is not moving) exerted by each fluid in the annulus 17 at any vertical depth based on the fluid properties, e.g., such as density, viscosity and the rate at which the fluids are pumped through the wellbore. The graph 14 may be displayed to assist the system user in evaluating whether the pumping rate will enable the fluids to provide both sufficient hydrodynamic pressure in the annulus 17 to prevent fluid influx from exposed formations 18 and low enough hydrodynamic pressure to avoid fluid loss to any formation by reason of the fluid hydrodynamic pressure exceeding the fracture pressure of any formation. In the example shown in FIG. 1, the pipe 16 is initially filled with cement 19. The cement 19 is intended to be displaced from the interior of the pipe 16 into the annulus 17 to a selected axial position (depth). Depending on the characteristics of the formations 18, the cement 19 may be preceded by, in the present non-limiting example, drilling fluid ("mud"), a "preflush" formation conditioning fluid 21 and a spacer fluid 23. Each of the foregoing fluids 19, 21, 23 may have selected rheological properties including density and viscosity that will affect its respective ECD as the entire set of fluids is displaced by pumping fluid following the cement 19 inside the interior of the pipe 16. As will be appreciated by those skilled in the art, the shallowest end of the cement 19 inside the pipe 16 may be followed by a "wiper plug" (not shown), which separates the cement 19 from the fluid following (not shown) and is used to cause the interior of the pipe 16 to be cleaned of any residual cement as the cement 19 is displaced from the interior of the pipe 16. The fluid (not shown) used to displace the cement 19 by pumping may be drilling mud having selected rheological properties, or any other selected fluid.

In some embodiments, a curve 24 may be presented that is indicative of the expected amplitude of detected acoustic energy that is reflected by the interior of the pipe 16 after the cement 19 is fully displaced. The amplitude of the reflected acoustic energy may be indicative of the degree of bonding of cured cement 19 to the exterior of the pipe 16. The foregoing curve 24 may assist in predicting the quality of zonal (i.e., between drilled formations) isolation in the annulus 17. In an example embodiment according to the present disclosure if the predicted zonal isolation quality is low, a display may be generated for the system user indicating possible remedial actions for example and without limitation rotating the casing 16 at a selected speed and reciprocating the casing 16 axially. Rotating or reciprocating the casing 16 may urge the cement 19 into areas where there is apparent weak zonal isolation. As a result, the previously weakly isolated zones and the overall quality of the cementing operation may be improved during the cementing operation.

Figure 2:
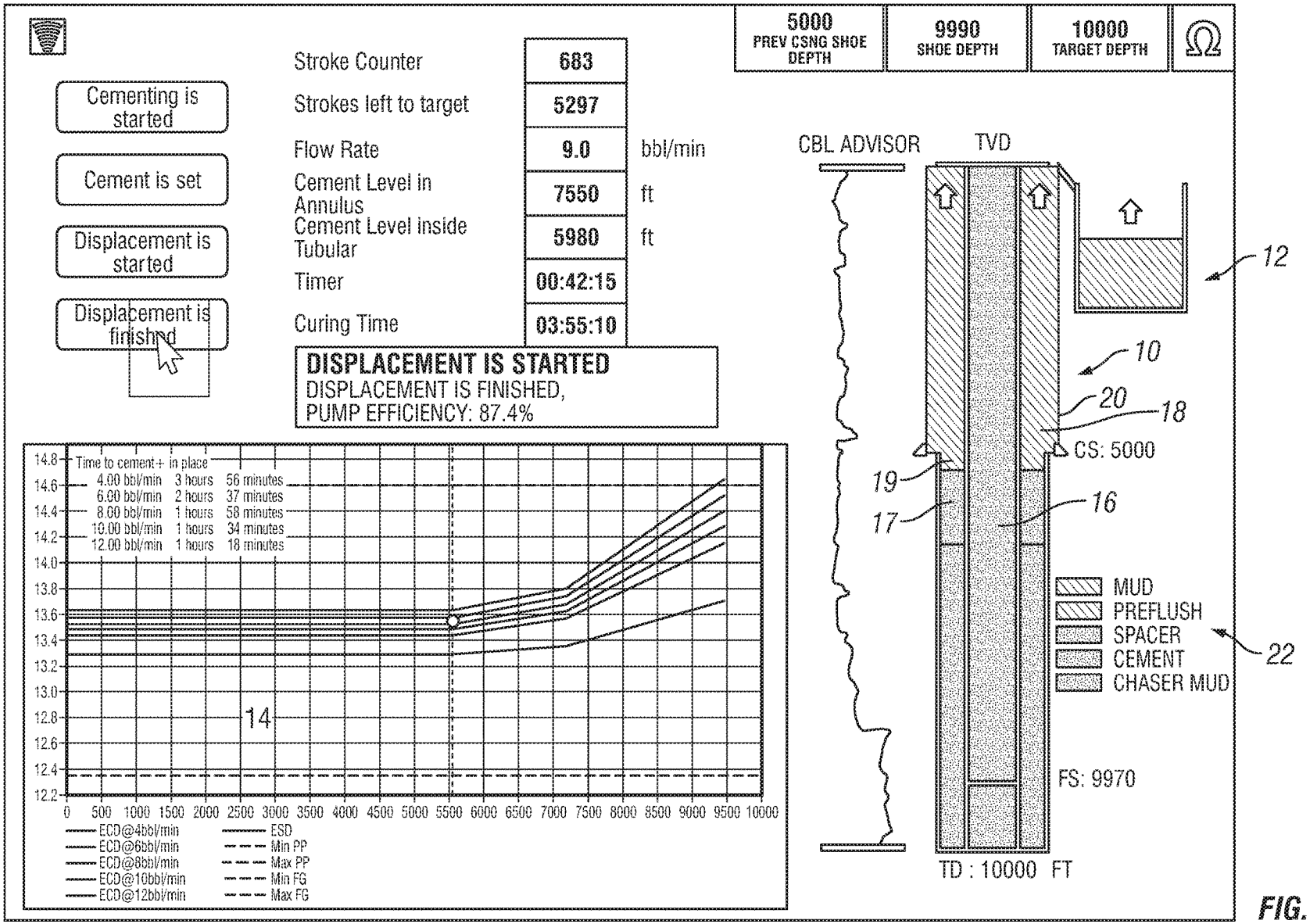
FIG. 2 shows a similar display screen as FIG. 1, wherein fluid movement is underway.

FIG. 2 shows the same display as FIG. 1, wherein displacement of the cement and preceding fluid(s) has been started. It may be observed in FIG. 2 that cement 19 has moved into the annulus 17 to a particular level (axial position).

An example embodiment according to the present disclosure may detect when the cement 19 or any preceding fluid reaches the surface of the annulus 17 or any selected depth within the annulus 17 by using a flow meter to measure the fluid flow rate out of the annulus 17. The flow rate measurement may be integrated to determine total fluid flow volume, or the volume may be measured using a fluid level sensor for the tank, shown graphically at 22 in FIGS. 1 and 2. For example, the flow rate may be measured using a flow meter such as a Coriolis flow meter or a flow paddle combined with a step change detection algorithm. An example embodiment may detect the fluid property change by interpreting changes in the measured fluid flow rate out of the annulus. Fluid property changes may be, for example and without limitation, the viscosity and the density of the fluid. An example embodiment according to the present disclosure may detect a change in the type of fluid leaving the annulus 17 from a first viscosity to a second viscosity mud or from mud to cement.

A Coriolis flow meter, if used, will detect a density change, which may be correlated with the viscosity of the fluid discharged from the annulus 17, if and as necessary. A Coriolis flow meter may be used to determine the time at which there is a significant change in the viscosity of fluid being discharged from the annulus 17, assuming that higher viscosity will result in higher density due to elevated cuttings percentage or other solid content in the fluid. Density measurements may show no substantial change when the viscosity changes. For such case, the user may have the option to manually input the time when the change in discharged fluid is observed on the surface or when the displacement of the fluid is completed.

A flow paddle may be used together with an algorithm for step change determination, in an example embodiment according to the present disclosure, to detect when there is a significant change in the density or in the viscosity of the discharged fluid. Various algorithms for performing such detection are known in the art.

In cases where the well construction plan provides that cement 19 is to be displaced in the annulus 17 all the way to the surface, an example embodiment may automatically detect when the cement 19 is at the surface by analyzing the discharged fluid flow rate variation that can result from, e.g., the density/viscosity variance between the mud and cement, spacer and cement or spacer and mud.

For well construction plans where the cement is not intended to be displaced to the surface, the planned axial length of the cement 19 in the annulus 17 may be input into the system by the user, e.g., using a touch screen as shown in FIGS. 1 and 2. In an example embodiment, the computer or computer system may calculate the axial position (i.e., the measured depth in the wellbore) of the top of the cement using measured fluid volume pumped into the wellbore (e.g., using a stroke counter on the pump as an input signal), and using either an assumed input annulus profile (volume per unit length) or an annulus volume profile obtained, e.g., from measurements made during drilling or during pumping of traceable fluid through the annulus 17, may generate an indication or an alarm signal to alert the user when the top of the cement 19 reaches the desired axial position (measured depth) in the annulus 17. The alarm signal may be audible and/or displayed on a screen such as shown in FIGS. 1 and 2

In an example embodiment according to the present disclosure, the computer system (FIG. 8) may calculate the hydrostatic and hydrodynamic pressure of fluid in the annulus 17 with respect to axial position using the rheological properties of the various fluids and their axial lengths. The pressure profile of the fluid may be calculated for various flow rates, e.g., for each pump stroke during or prior to the pumping operation. During pumping, a calculated pressure profile may be displayed for various flow rates and may be tracked based on measurements of fluid flow rate into the pipe (16 in FIGS. 1 and 2). An example pressure profile is shown at 14 in FIGS. 1 and 2. If additional sensor measurements such as: pressure of the fluid as it is pumped into the pipe, flow rate of the fluid out of the annulus, or fluid tank levels is available, such measurements may be used together with the calculated pressure profile. If the determined flow rate is outside of the boundary of the predetermined and measured pressure profiles and does not match with a predetermined threshold difference, then an alarm signal may be generated and shown in the display to the system user. For example, in the case of a rapid decrease in fluid pumping pressure, the pressure decrease may be cross-referenced to measurements of fluid flow rate into the pipe and fluid flow rate out of the annulus (flow differential), and the tank fluid level measurement. An alert signal may be generated by the computer system and displayed to the user if the flow differential and/or the measured tank fluid level indicate a loss of fluid from the wellbore into the formations. The same measurements may be used to determine whether a fluid influx occurs, for example, when the measured pumping pressure increases. In such event a corresponding alert signal may be generated by the computer system and conducted to the user display (FIGS. 1 and 2).

In an example embodiment according to the present disclosure, the computer system (FIG. 8) may monitor measured fluid losses/gains during fluid "sweeps" and pumping operations by analyzing the foregoing measurements. A step change algorithm may be used by the computer system to determine the location (axial position or measured depth) of the influx or the fluid loss by analyzing the measurements specified above. For example, the flow rate into the pipe and the mud tank levels may be measured during pumping a fluid. The total volume pumped into the pipe may be measured (e.g., using the pump stroke counter or a flow meter) and the total volume expected to be discharged from the wellbore is calculated. If there is a discrepancy between these volumes, then a step change algorithm may be used by the computer system to find the axial position (i.e., identify a particular formation) of a possible kick or influx by analyzing the respective ingoing and outgoing fluid volumes. Other measurements such as pressure may be used together with the volume information by the computer system (FIG. 8) in order to increase user confidence in the conclusion that there may be an influx of fluid from or a loss of fluid to the identified formation. A set of possible influx/fluid loss events and confidence percentages where various kind of sensors can be used together to determine the likelihood an influx or a loss.

Figure 6:
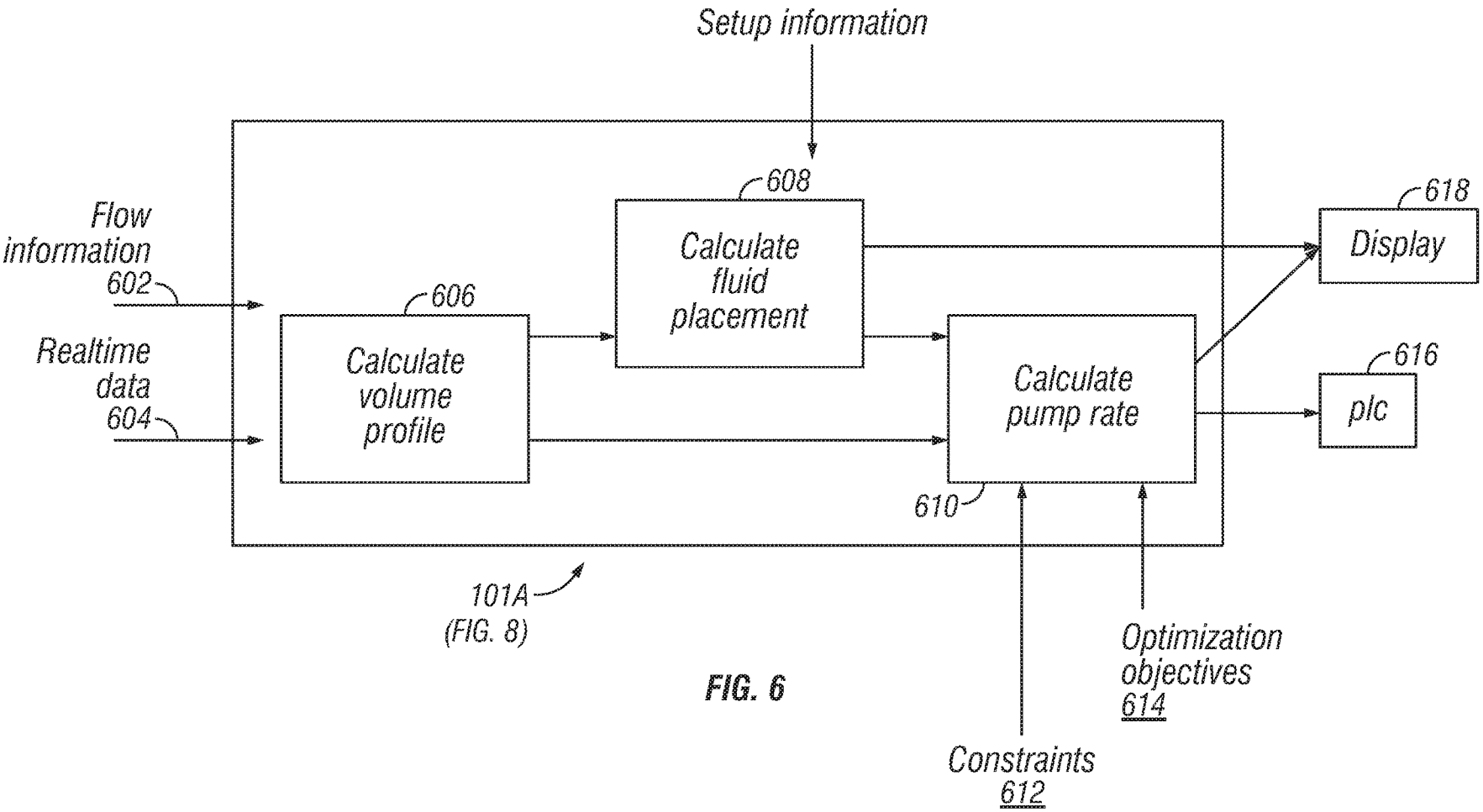
FIG. 6 shows an example embodiment that may be capable of tracking and managing drilling fluids.

FIG. 6 shows an example embodiment that may be capable of tracking and managing drilling fluids. The computer system 101A may accept as user input initialization data such as detailed information concerning the configuration of a bottom hole assembly (BHA) at the end of a drill string, tubular definitions as well as a set of fluid flow constraints at 612 to be enforced and a set of fluid flow optimization criteria at 614. During drilling operations the computer system 101A continually receives, at 604 real time drilling data such as bit depth, wellbore total depth, axial force on the drill bit (WOB), hookload, stand pipe (fluid pumping) pressure, etc. The computer system 101A may also receive as input, at 602, real time fluid flow information such as flow rate into the pipe, flow rate of fluid out of the annular space, tank or pit levels, density measurements, etc. The computer system 101A may continually use the foregoing input data to construct a borehole volume profile at 608. The borehole volume profile is used to continually calculate the placement or position of the various fluids in the pipe and the annulus and may display the results of such calculation on a computer display (FIGS. 1 and 2). The borehole volume profile and the fluid placement may then be used by the computer system 101A using a pump rate calculation algorithm that determines, at 610, an optimum fluid pumping rate to: (i) satisfy the constraints such as ECD considering a gel breaking pressure of each of the fluids and drill cuttings management to maintain the ECD profile along the wellbore within a safe operating envelope; (ii) optimize a fluid pumping rate to accomplish objectives such as maintaining a desired wellbore annulus pressure profile, maintaining or inducing a desired flow state; and (iii) determining the appropriate equipment modifications that would positively influence the optimization objectives. The calculated pump rate may be output on a display at 618. The calculated pump rate and it may in some embodiments be sent to a controller at 616, including, for example a PLC, for automatic control over the fluid pumping rate with or without user confirmation or override.

In an example embodiment of a lost circulation index calculation, the computer system (FIG. 8) may calculate an estimate a likelihood of a lost circulation event by using several data sources such as nearby ("offset") well information, offset or current well log measurements (one or more physical parameters of the formation), or any other sensor measurements that can be used to obtain a formation property. Formation correlation may be performed automatically by the computer system with respect to offset well data. The lost circulation index is calculated and may be displayed to the user in real-time. A quantitative value of lost circulation index may be calculated by the computer system by correlating the formations penetrated with respect to depth of the current well to measurements made in one or more offset well(s).

By measuring the amount of fluid pumped into the pipe in the wellbore and monitoring, manually or automatically, when that fluid reaches the surface, the volume of the wellbore can be estimated. The wellbore volume can be adjusted as the borehole is elongated based on the bit size and consequent increase in measured depth. The estimated wellbore volume can then be compared to estimations calculated for subsequent fluids pumped to determine if there has been a fluid influx or loss event. From this volume measurement a "gauge factor" may be calculated for the wellbore from either the surface to the current depth, or from the depth where a previous wellbore volume had been calculated and the current wellbore depth. The gauge factor may be defined as the ratio between the wellbore volume calculated using drill bit diameters and the wellbore diameter inferred from the volume measurement. Each time a discrete volume of fluid with different properties is pumped, the gauge factor may be calculated for the portion of the unfinished borehole extending from the depth of the previous gauge factor calculation and the current depth according to an expression such as:

$$(\text{Gauge Factor})_i = \left(\frac{HoleDiameter_{calculated}}{HoleDiameter_{ideal}}\right)_i$$

In example embodiment the computer system (FIG. 8) may calculate the ECD based on rheological properties of the various fluids, the measured pressure and the measured rate of fluid flow into the pipe. The calculated ECD may be compared with the formation fracture pressure, and the pipe collapse and burst pressures during cement pumping in real-time. The computer system may generate a warning indication for display to the system user of the ECD approaches a formation fracture pressure or a formation fluid pressure within a predetermined safety threshold. The formation fluid and fracture pressures may be predetermined using methods well known in the art. Calculating an ECD or annulus pressure profile using the foregoing measurements and rheological properties of the fluids in the pipe and annulus may be performed using a wellbore hydraulics model such as one described in U.S. Pat. No. 6,904,981 issued to van Riet.

In an example embodiment according to the present disclosure the computer system may generate alerts or warning displays to the system user by determining a difference between a calculated ECD and a predetermined ECD. If, for example, the drilling unit operator ("driller") operates the fluid pumps to that the fluid flow rate into the pipe results in ECD over a predetermined limit (for example, the fracture pressure less a safety factor) or if the trend of the ECD indicates that the fracture gradient will be crossed with the current ramp up in the flow rate, the system may generate a display that advises the driller to decrease the flow rate of the pumped fluid.

In example embodiment according to the present disclosure the computer system may generate a display of a recommended fluid flow rate (e.g., the maximum) based on the permissible ECD according to the fracture pressure profile in the annulus (17 in FIG. 1). In one example, the driller may operate the fluid pumps at a relatively high rate when the spacer fluid is in the annulus (17 in FIG. 1) and the cement (19 in FIG. 1) is still fully inside the pipe (16 in FIG. 1). Once the cement begins to enter the annulus, the computer system may calculate and display a reduced pumping rate. Such reductions in pumping rate may be in steps depending on the ECD/fracture pressure profile. Those skilled in the art will recognize that the foregoing is similar to surge and swab pressure estimations. In example embodiment the computer system may continuously calculate the location of the top of the cement, mud and spacer in real-time and may use these locations along with the calculated ECD profile resulting therefrom to determine a maximum fluid flow rate that may be used without fracturing any exposed formation. As more cement moves into the annulus, the calculated maximum safe flow rate may be displayed to the system user and/or the driller to guide the driller through the pumping operation.

While managing the flow rate with respect to constraints such as the ECD profile or required drill cuttings transport, fluid pumping may be optimized during fluid placement for one or more conditions such as desired laminar or non-laminar flow at wellbore section(s), bottom hole pressure, casing shoe pressure, minimum or maximum fluid mixing, minimized free-fall effects and maximized drill cuttings transport.

Figure 7A:
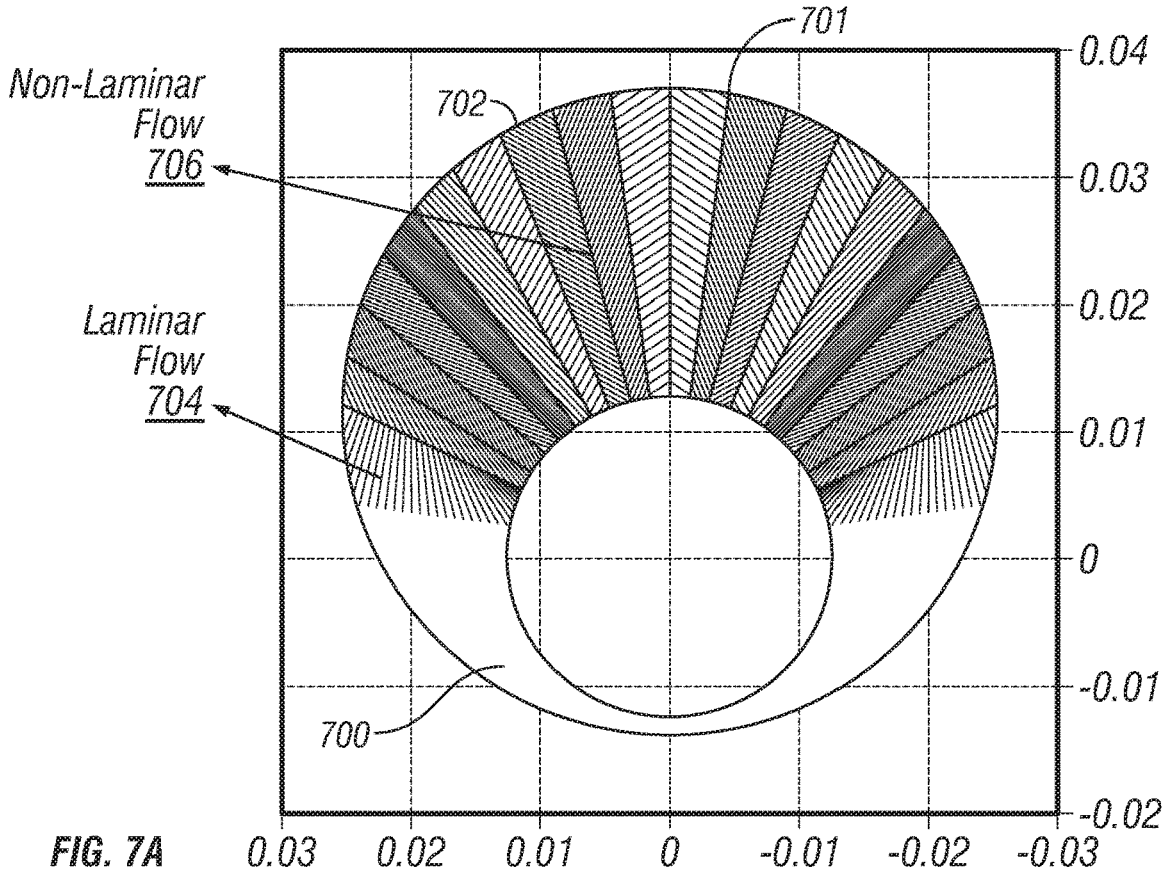
FIG. 7A shows an example distribution of fluid flow in a nested eccentered pipe.

FIG. 7A shows an example of a pipe 700 nested inside either another pipe or a wellbore 702. The pipe 700 is eccentered within the other pipe or wellbore 702. Flow induced in the annular space 701 outside the nested pipe 700 may have more than one type of flow because of the unequal circumferential distribution of the volume of the annular space 701 outside the nested pipe 700. In the example shown in FIG. 7A, laminar flow may occur in the circumferential zone indicated by numeral 704. Non-laminar (e.g., turbulent) flow may occur in the circumferential zone indicated by numeral 706.

Figure 7B:
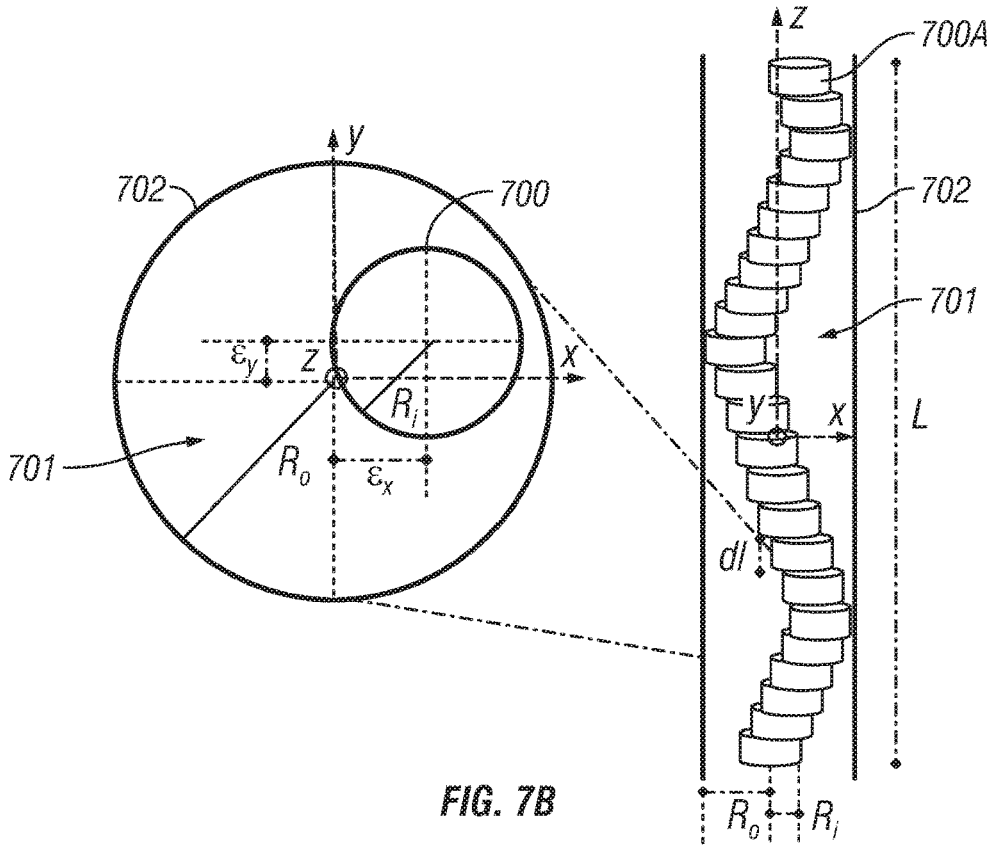
FIG. 7B shows an example of wellbore fluid flow stability profile model.

A three dimensional (3-D) flow state profile in the annular space may be constructed as shown in FIG. 7B. The user may determine the section(s) along the measured depth of a wellbore for a desired flow state (such as laminar, transitional, turbulent) and the flow rate required to sustain the desired flow state may be calculated. A 2- or 3-D flow state profile of the wellbore may be displayed to the user. In FIG. 7B, the model may include a representation of the wellbore at 702. A drill string may be represented at 700. Ri represents the diameter of the drill string. Ro represents the diameter of the wellbore. $\varepsilon_x$ represents displacement of the axial center of the drill string from the center of the wellbore in one direction transverse to the length of the wellbore. $\varepsilon_y$ represents the axial center displacement in the orthogonal direction. The drill string 700 may be modelled as a plurality of axial segments 700A such that a 3-D model of the annular space 701 may be made over a selected axial interval L of the wellbore 702. The particular implementation used may calculate the stability of the flow locally in 2-D annular space (i.e., at a single axial position along the wellbore) considering the drill string position and motion within the annular space 701. In such manner, a flow state map of the wellbore may be constructed in real-time using the fluid properties and directional survey information concerning the wellbore. An example embodiment according to the present disclosure may be used to automate control of the fluid pumping rate. The calculated maximum pumping rate describe above may be used to operate a controller, such as a PLC in signal communication with a pump speed controller. The maximum permissible pumping rate based on the calculated ECD profile may be maintained, in some examples.

An example embodiment calculates the number of pump strokes (for reciprocating positive displacement fluid pumps) required to displace the cement to the desired position in the wellbore. An example embodiment calculates the positions of the fluids within the annulus automatically based on the total pump displacement and may display the results thereof to the user.

In an example embodiment the ECD profile and fluid position calculations described above may be performed by the computer system (FIG. 8) contemporaneously with automatic detection of the rig state to initiate the system with automated detection of the cementing. One non-limiting example of automatic determination of rig states is described in U.S. Pat. No. 6,892,812 issued to Niedermayr. For example, a distinction between tripping a drill string into the wellbore and running in a casing or liner may be made by analyzing the hook-load, or the block position variation with an assumption on a general casing or liner segment ("joint") length. Cementing, following a casing run, can be detected using surface sensor measurements such as bit depth, wellbore depth, fluid pressure, flow rate out, etc. After cementing is detected as explained above, cement on the surface may be detected by analyzing the flow rate out and a fluid with at least one different rheological property may be detected as it is described previously. If low density cement is used and it may be difficult to detect the cement returning to the surface by checking the pumping pressure and the measured flow rate out of the annulus. When the rig state detects cementing, the sensitivity of the system to a fluid property change detection can be increased this way using the rig state, detection of the cement on surface can be performed more reliably and may provide a more reliable indication when the cement has reached the surface. The system user can choose to visually observe the fluid being discharged from the annulus to determine the position of the cement top rather than using the automated fluid top position detection in cases where it may be necessary to do so.

An example embodiment may compare the fluid flow rate in to the wellbore (e.g., using the pump operating rate) and the flow rate out of the annulus (e.g., using a flow meter as described above), to characterize the free fall phenomenon ("U-tube effect") that may result from having different density fluid inside the pipe than in the annulus. An example embodiment may estimate a "catching up with the plug" rate and may generate a display to advise the system user (driller) to increase the fluid pumping rate. The foregoing may also be performed automatically in some embodiments. During the deceleration phase of the cement (i.e., as the weight of the fluid column in the annulus beings to exceed the weight of the fluid column in the pipe after all the cement is displaced therefrom), the system may generate a display to advise the system user to increase the pumping rate to maintain the fluid flow rate of the fluid column in the annulus at the planned/desired flow rate. The foregoing pumping rate change may also be implemented automatically. An example embodiment according to the present disclosure may generate a display showing the system user a range of optimized flow rates for better cement bonding without fracturing the formation. Maintaining flow rate within the range may also be implemented automatically in some embodiments.

Turbulent flow of the cement may be desirable for better cement bonding, but empirical measurements have shown laminar flow during the deceleration phase. During the spacer placement, cement is better as plug flow to ensure filling in all the nooks and crannies of the wellbore. An example embodiment according to the present disclosure generates a display for the user to keep the fluid pumping rate within a predetermined range for an optimized bonding. The flow rate for an optimum flow state for that specific operation may be calculated by the system as described with reference to in FIG. 6 as an optimization objective. The foregoing control of fluid pumping rate may also be performed automatically.

In an example embodiment according to the present disclosure the computer system (FIG. 8) may compare a predicted fluid flow rate out of the annulus based on the flow rate pumped in and the measured flow rate out of the annulus to determine cement acceleration and deceleration. The foregoing may be used by the computer system to generate a display (FIGS. 1 and 2) for the user to selectively control the fluid pumping rate so that optimum fluid movement rate in the annulus may be maintained. The foregoing may also be implemented to automatically control the fluid pumping rate.

In an example embodiment according to the present disclosure the computer system may use the information obtained during drilling to better determine the actual wellbore volume by the data measured during the sweeps and the continuous tracking of the fluid volume as previously described. The mud volume in the tank may be analyzed by comparing the calculated and measured volumes during tripping and casing operations.

Figure 3:
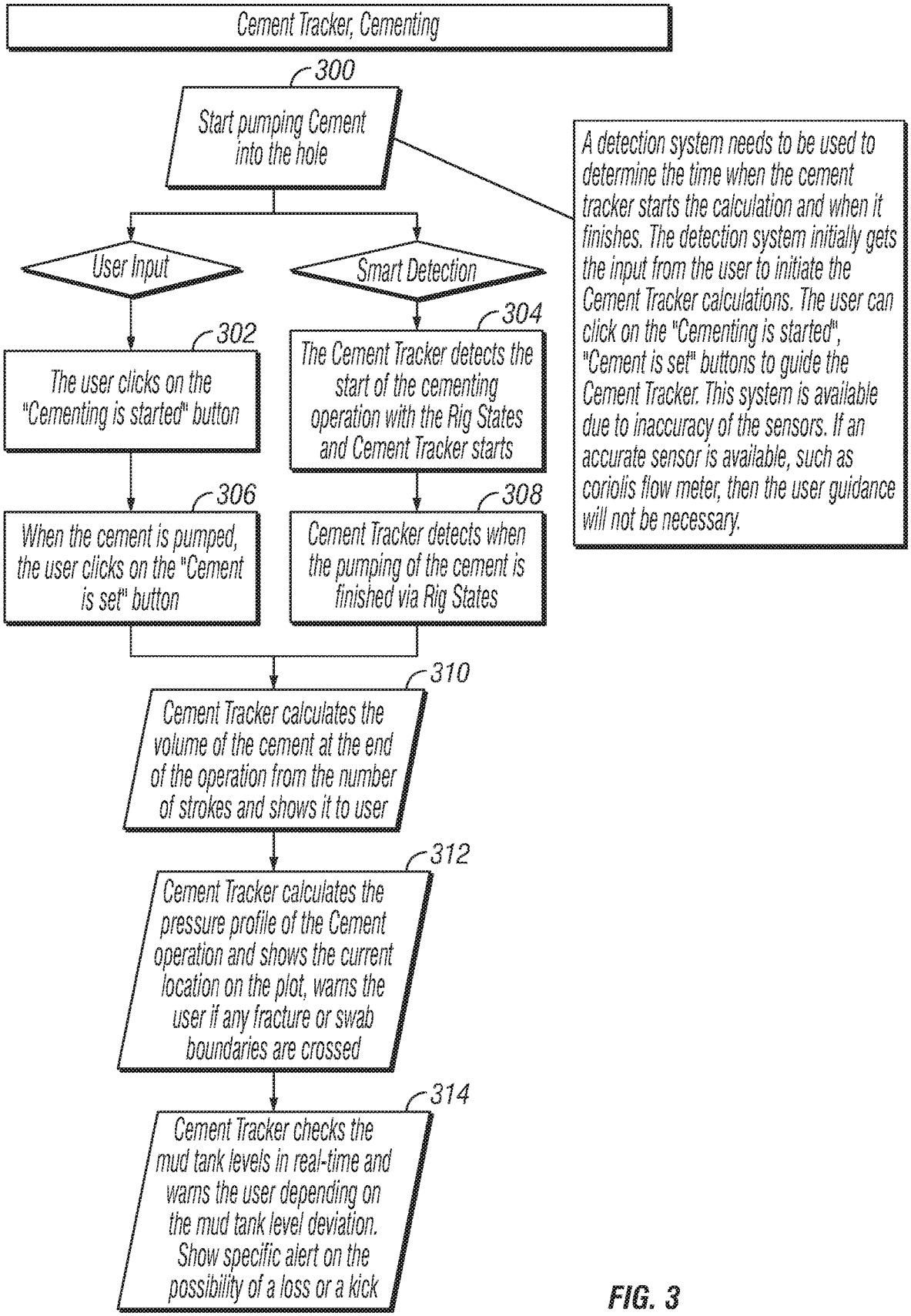
FIG. 3 shows a flow chart of an example method wherein movement of cement in the annulus is monitored.
Figure 4:
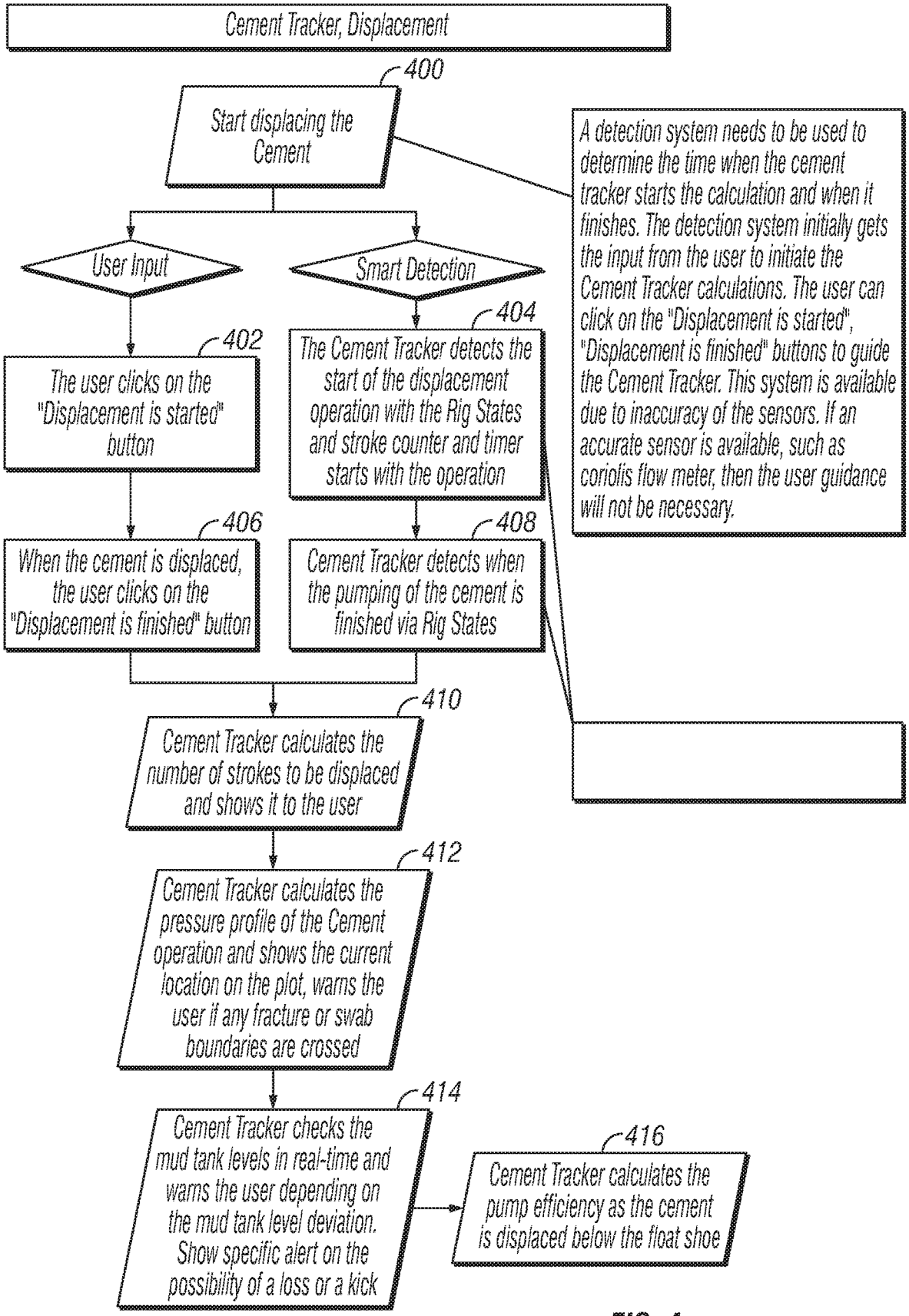
FIG. 4 shows a flow chart of an example method similar to FIG. 3 wherein pump efficiency is calculated.
Figure 5:
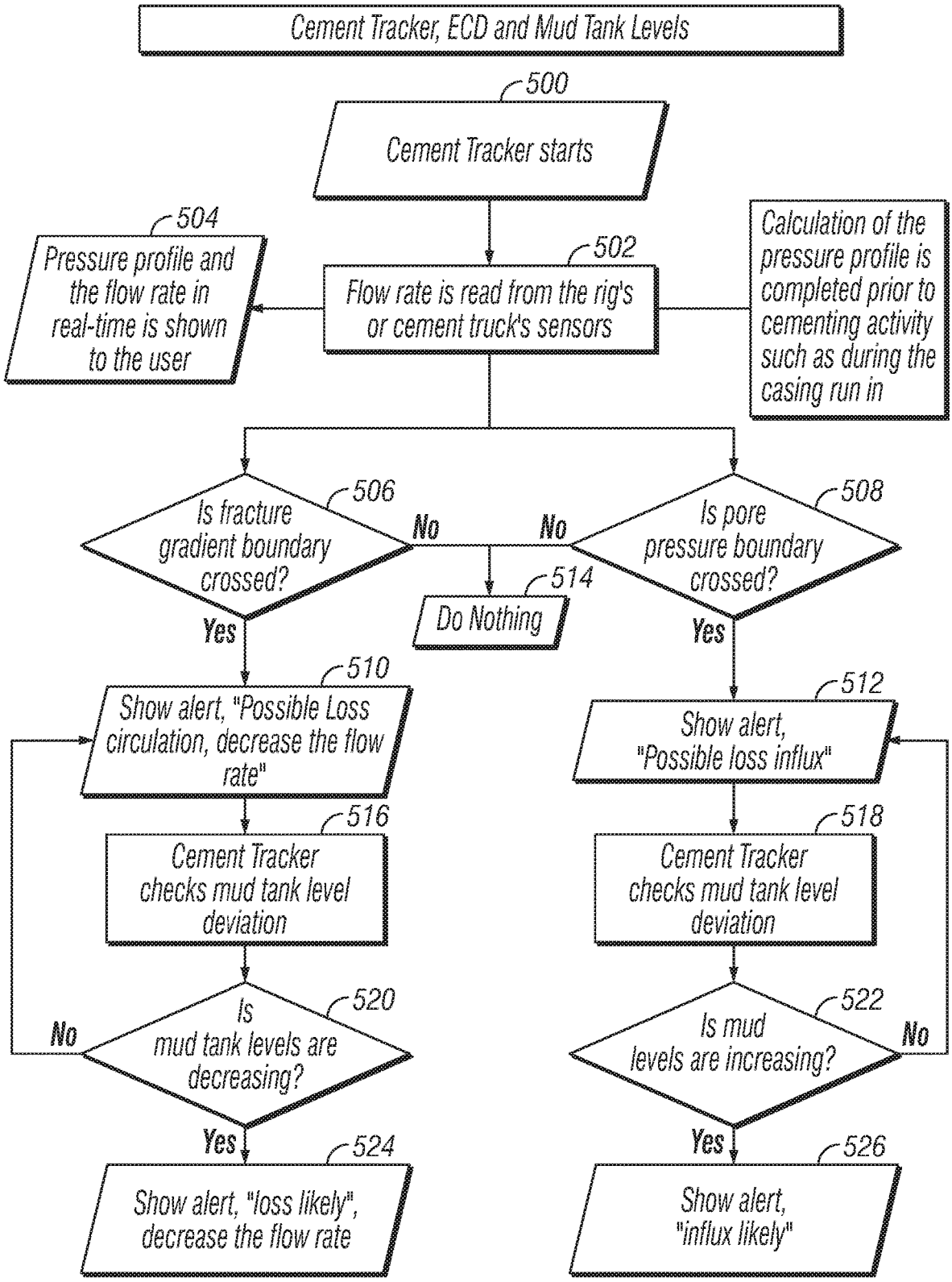
FIG. 5 shows a flow chart of an example method wherein annulus pressure may be calculated in real time and used to present a display to the system operator that a fluid influx or fluid loss event may occur.

Example embodiments of methods according to the present disclosure may be better understood with reference to flow charts shown in FIGS. 3-5. Referring first to FIG. 3, after placement of the preflush and spacer stages (if used) pumping cement may be initiated at 300. Tracking of the cement movement may be initiated automatically at 304 using input from the various sensors described above (pump pressure, pump rate and flow rate out of the wellbore) or may be initiated manually by the system operator entering a command, e.g., such as on a touchscreen as shown in FIG. 1. At 308, the volume of cement pumped may be automatically detected as explained above and an indicator may be displayed on the user display when a predetermined volume of cement is pumped. The user may manually enter the same information by appropriate input to the system at 306. After the selected cement volume is pumped into the pipe (e.g., casing or liner) at 310 the position of the top of the cement may be determined as explained above. The position of the top of the cement may be displayed substantially continuously on the display (e.g., as in FIG. 2).

At 312, during pumping of the cement, an annulus pressure profile or ECD may be calculated using the pumping rate, pumping pressure, rheological properties of the cement, preceding and following fluids and the measured fluid flow rate out of the wellbore. If at any axial position along the annulus pressure profile or ECD profile it is determined that the fluid pressure or ECD either exceeds an upper safe limit (approaches the formation fracture pressure) or falls below a lower safe limit (approaches a formation fluid pressure), a warning indicator may be generated by the computer system and displayed to the system user. The system user may then manually adjust the fluid pumping rate to adjust the pressure or ECD profile. In some embodiments the computer system may automatically adjust the pumping rate to relieve the potentially hazardous condition.

At 314, in addition to comparing the calculated pressure profile to a predetermined pressure profile, a discharged fluid volume (e.g., as measured by a discharged fluid tank level sensor) may be compared to the volume of fluid pumped into the well (e.g., as may be measured by integrating the pump stroke counter). Differences between the fluid volume pumped into the pipe and the volume discharged from the well annulus may be inferred by changes in take level. In the event the tank level drops, it may be inferred that a fluid loss event has taken place and the fluid pumping rate should be decreased. Conversely, in the event the tank level increases, it may be inferred that a fluid influx has taken place and the fluid pumping rate should be increased. In some embodiments, the foregoing changes to fluid pumping rate may be implemented manually by the system operator (e.g., the driller) upon viewing indications of the fluid loss or influx on the display. In some embodiments, the fluid pumping rate may be automatically adjusted by the system in response to measured changes in the tank level.

Referring to FIG. 4, once all the cement has been pumped as explained with reference to FIG. 3, displacing the cement may be initiated so that the cement is disposed in the annulus with a cement top at a selected depth (either at the surface or at a selected axial position below the surface). Cement displacement may be initiated at 400 by pumping fluid such as drilling mud to displace the wiper plug inside the pipe as explained above. The system user may enter an input at 402 to manually track displacement of the cement into the annulus, or the system user may select automatic tracking of the cement displacement at 404. In manual operation, the system user may observe and manually tally the volume of fluid pumped to displace the cement and/or may observe the pumping pressure to determine when the wiper plug has reached the bottom of the pipe ("bumping the plug"). At 406, the system user may enter an input when the cement displacement is completed. At 408, the system may automatically determine when the cement displacement is completed by measurement of the volume of fluid pumped to displace the cement. At 410, the volume of fluid pumped to displace the cement may be displayed to the user. At 412, an annulus pressure profile or ECD profile may be calculated and compared to a predetermined annulus pressure profile or ECD profile. Variations in the pressure or ECD at any point along the profile which exceed predetermined limits (similar to the cement pumping operated as shown in FIG. 3 at 312) may be used to generate a display for the system user to adjust the displacement fluid pumping rate accordingly. In some embodiments, the displacement fluid pumping rate may be adjusted automatically. At 414, fluid loss or fluid influx may be determined by measurement of changes in tank level, substantially as explained with reference to the cement pumping shown at 314 in FIG. 3. Similarly, the displacement fluid pumping rate may be manually or automatically adjusted to alleviate the fluid loss or influx.

At 416, a pump efficiency may be calculated and displayed to the system user on the system display. When the user selects the "Displacement is started" button on the user input, or the computer system automatically detects the start of displacement fluid pumping, a pump efficiency calculation starts. The efficiency of the pump may be calculated using as the inputs the pipe inner diameter, total length of the pipe, location of the float collar (or float shoe) and the planned pump rate (e.g., in strokes per unit time). The displacement starts and the cement is displaced until the top plug sits on the bottom plug. A trend detection algorithm can be used in connection with measurements of the pump pressure ("standpipe" pressure) to automatically detect when the wiper plug reaches the bottom of the pipe. The volume of the pump operation may be integrated to obtain a total displacement volume of the pump. The actual pumped volume of fluid, which may be calculated based on the above parameters of the pipe may be compared to the volume of the pump operation to calculate the pump efficiency.

FIG. 5 shows an example embodiment of determining possible fluid influx or fluid loss events, and control of the fluid pumping rate during pumping of the cement and/or the cement displacement fluid. At 500, pumping the cement or displacement fluid is initiated. At 502, a flow rate of the fluid may be determined by using sensor measurements, e.g., a stroke counter on the pump, or a flowmeter if desired. Based on the flow rate of the fluid into the pipe, the rheological properties of the fluids in the pipe and in the annulus, and the pump pressure, an annulus pressure profile may be calculated. The annulus pressure profile may be displayed to the user at 504. The following actions may be implemented manually by the system user (e.g., the driller) or may be implemented automatically. At 506, the calculated pressure profile is compared to a maximum pressure profile (i.e., a fracture pressure less safety margin pressure profile). At 508, the calculated pressure profile is compared to a minimum pressure profile (i.e., a formation fluid pressure plus safety factor pressure profile). If neither the maximum nor minimum pressure profiles are traversed by the calculated pressure profile, then the fluid pumping continues unchanged at 514.

At 510, if at any point the maximum pressure profile is traversed by the calculated pressure profile, a warning indication is generated and displayed to the user. The user may reduce the fluid pumping rate manually, or the fluid pumping rate may be reduced automatically by the system until the pressure traverse is relieved. Contemporaneously, at 516, the fluid level in the tank may be measured. At 520, if a decrease in fluid tank level is detected, the system may generate a warning that will be shown on the display. The system user may manually reduce the fluid pumping rate in response to the warning or the system may automatically reduce the fluid pumping rate.

Corresponding actions in the event the minimum pressure profile is traversed at any point are shown at 512, 518, 522 and 526, respectively. If the minimum pressure profile is traversed, the fluid pumping rate may be manually or automatically increased.

The foregoing procedures may be implemented in some embodiments using a measurement that closely approximates the actual annulus volume. Such measurement may be made as follows. Initially, a certain amount of drilling fluid is prepared in one or more tanks for the drilling operations. As drilling commences, the drilling fluid in the tank(s) is pumped into the wellbore. As the wellbore volume increases, the volume of drilling fluid in the tank(s) decreases. A portion of the drilling fluid intrudes into the some of the formations, which intrusion is called the "spurt loss". Additionally, if solids control equipment is used to treat the drilling fluid returned from the wellbore, such equipment may cause loss of a certain amount of drilling fluid as it removes the solids from the returned drilling fluid. The user may manually input the amount of lost fluid to the computer system or the discharge rate of the solids control equipment can be specified at the beginning and operating time can be input to the computer system. The spurt loss into the formation and the wellbore volume increase may be calculated in real-time during the wellbore drilling.

Using such calculation and display, one can make inferences concerning the total wellbore volume by combining sensor data (such as bit depth) and total tank volume, and the metadata (such as drill string and drilling tool geometry) in the wellbore and casing set depth history. By comparing the measurements of fluid volume (inferred by fluid level) in the mud tank(s) and calculation of the spurt loss, wellbore volume increase due to drilling, drill string displacement, cuttings, solid content, etc. one may infer the actual volume of the wellbore. The foregoing inference assumes a closed system where there is no loss of drilling fluid to a formation or any fluid influx from the formation. In case of loss or influx, the influx volume may be determined and the inferred wellbore volume may be adjusted for the influx or loss volume.

Figure 8:
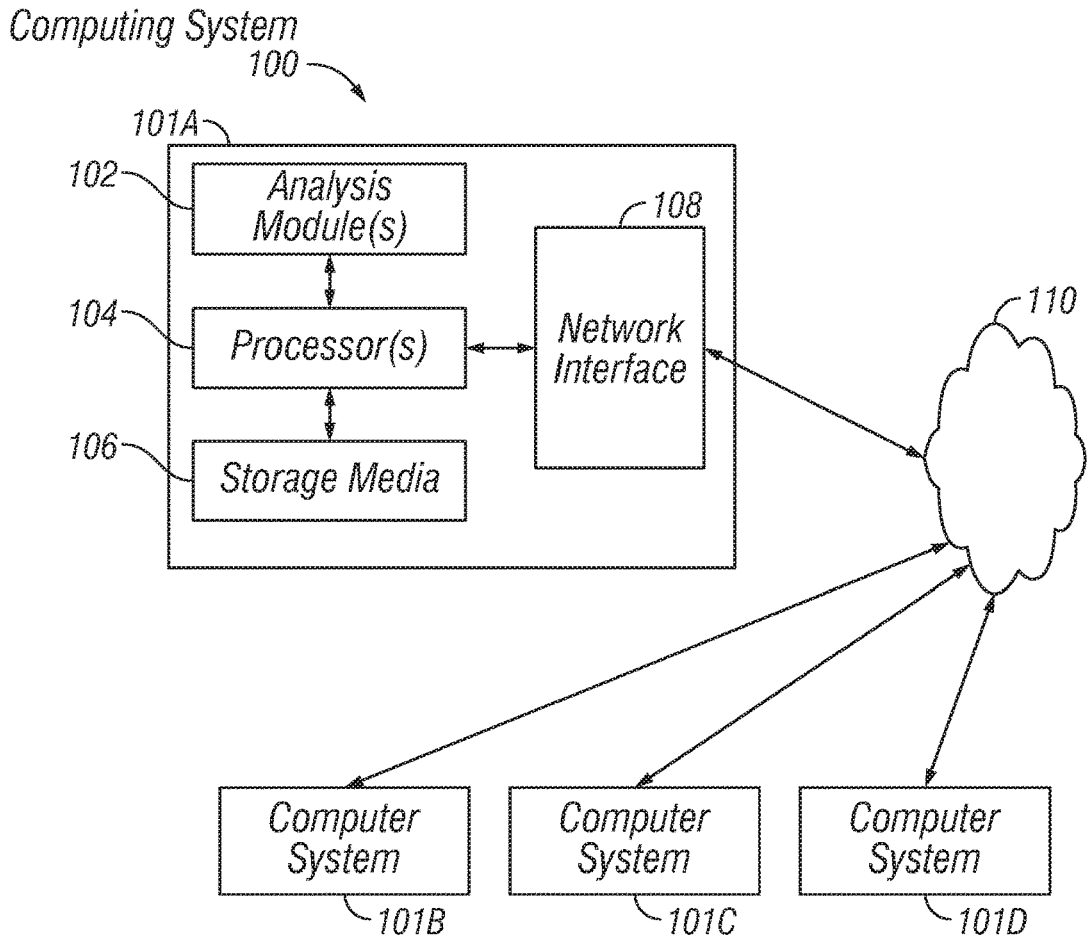
FIG. 8 shows an example computer system that may be used in some embodiments.

FIG. 8 shows an example computing system 100 in accordance with some embodiments. The computing system 100 may be an individual computer system 101A or an arrangement of distributed computer systems. The computer system 101A may include one or more analysis modules 102 that may be configured to perform various tasks according to some embodiments, such as the tasks depicted in FIGS. 1 through 7. To perform these various tasks, analysis module 102 may execute independently, or in coordination with, one or more processors 104, which may be connected to one or more storage media 106. The processor(s) 104 may also be connected to a network interface 108 to allow the computer system 101A to communicate over a data network 110 with one or more additional computer systems and/or computing systems, such as 101B, 101C, and/or 101D (note that computer systems 101B, 101C and/or 101D may or may not share the same architecture as computer system 101A, and may be located in different physical locations, for example, computer systems 101A and 101B may be at a well drilling location, while in communication with one or more computer systems such as 101C and/or 101D that may be located in one or more data centers on shore, aboard ships, and/or located in varying countries on different continents).

A processor can include a microprocessor, microcontroller, processor module or subsystem, programmable integrated circuit, programmable gate array, or another control or computing device.

The storage media 106 can be implemented as one or more computer-readable or machine-readable storage media. Note that while in the example embodiment of FIG. 7. The storage media 106 are depicted as within computer system 101A, in some embodiments, the storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above may be provided on one computer-readable or machine-readable storage medium, or alternatively, can be provided on multiple computer-readable or machine-readable storage media distributed in a large system having possibly plural nodes. Such computer-readable or machine-readable storage medium or media may be considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is only one example of a computing system, and that computing system 100 may have more or fewer components than shown, may combine additional components not depicted in the example embodiment of FIG. 8, and/or computing system 100 may have a different configuration or arrangement of the components depicted in FIG. 8. The various components shown in FIG. 8. may be implemented in hardware, software, or a combination of both hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of the present disclosure.

Figure 9:
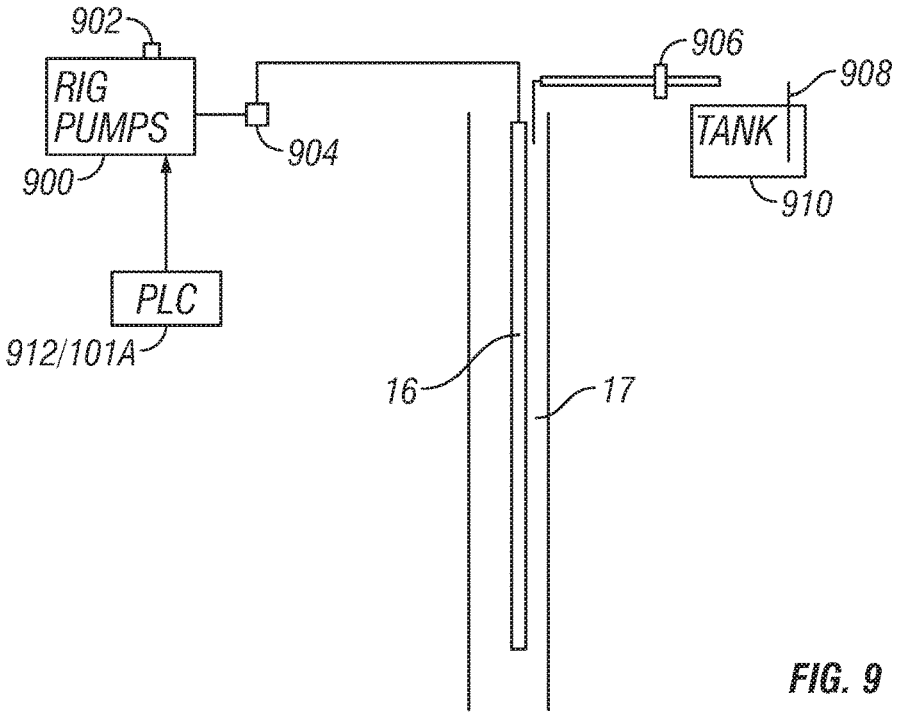
FIG. 9 shows schematically an example fluid pumping system and various sensors referred to with reference to FIGS. 1 through 6.

An example fluid pumping system and various sensors referred to with reference to FIGS. 1 through 6 are shown schematically in FIG. 9. The annulus 17 with the pipe 16 disposed therein include a fluid connection of the interior of the pipe 16 to the discharge of a pump or pumps, shown as "rig pumps" 900. A volume of fluid discharged by the pump 900 may be inferred by a stroke counter 902 coupled to the pump 900. In some embodiments a flow meter 904 such as a Coriolis flow meter may be included in the flow line from the pump 900 to the interior of the pipe 16. Discharge of fluid from the annulus 17 as fluid is pumped into the pipe 16 may be measured by a flow meter 906. As explained above the flow meter 906 may be a paddle flow meter, a volume or mass flow meter or a Coriolis flow meter. Fluid returning from the annulus 17 may be returned to a tank or tanks 910. A fluid volume in the tank(s) 910 may be measured using, for example a tank level sensor 908. The foregoing sensors may be in signal communication with the computer system 101A and a programmable logic controller 912. If a programmable logic controller 912 is used, operation of the pump 900 may be automated using control signals generated by the computer system 101A as explained above. In some embodiments, the system user may manually control operation of the pump 900 to obtain the desired flow characteristics as explained above.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method comprising:

during pumping of fluid into a borehole via a conduit in fluid communication with an annulus, defined in part by the conduit and defined in part by a formation that defines the borehole, to advance flow of cement in the annulus, receiving sensor-based measurements;

based on at least a portion of the measurements, determining an effective density exerted by at least the cement against the formation;

performing an effective density comparison between a predetermined effective density and the determined effective density;

determining a pressure profile with respect to depth based at least in part on the effective density;

performing a pressure comparison of at least one warning pressure to the pressure profile; and based on the pressure comparison or the effective density comparison, issuing a notification.

2. The method of claim 1, comprising determining a top of the cement position in the annulus.

3. The method of claim 2, comprising displaying the top of the cement to a display.

4. The method of claim 1, comprising, based at least in part on the top of cement position in the annulus, issuing a notification as to a maximum flow rate for the pumping of fluid.

5. The method of claim 1, wherein the notification comprises an instruction to adjust the pumping of fluid.

6. The method of claim 5, wherein the instruction to adjust is an instruction to decrease a flow rate of the pumping of fluid.

7. The method of claim 1, wherein the notification comprises an instruction to adjust the pumping of fluid.

8. The method of claim 7, wherein the instruction to adjust decreases a flow rate of the pumping of fluid.

9. The method of claim 1, comprising determining that cement flow in the annulus is laminar, non-laminar or laminar and non-laminar.

10. The method of claim 9, wherein, for the conduit being eccentered in the borehole, determining if laminar cement flow and non-laminar cement flow exists in the annulus.

11. The method of claim 1, comprising determining a range of flow rates for the pumping of fluid for improving cement bonding without fracturing the formation.

12. The method of claim 11, comprising issuing control instructions to maintain the flow rate for the pumping of fluid within the range.

13. The method of claim 11, wherein the range comprises flow rates for turbulent cement flow in the annulus.

14. The method of claim 11, wherein, for a deceleration phase, the range comprises flow rates for laminar cement flow in the annulus.

15. The method of claim 1, wherein, the effective density is an equivalent circulating density.

16. The method of claim 1, comprising displaying the effective density with respect to depth to a display.

17. The method of claim 1, comprising displaying a graphic of the annulus and a dynamic representation of cement in the annulus with respect to depth.

18. The method of claim 1, comprising display a graphic of the annulus and at least one indicator as to flow of cement in the annulus, wherein the at least one indicator comprises a laminar flow indicator, a non-laminar flow indicator or a laminar flow indicator and a non-laminar flow indicator.

19. The method of claim 18, wherein the annulus is eccentric.

20. The method of claim 19, wherein the eccentricity varies with respect to depth.

21. A system comprising:

a processor;

memory; and machine-readable instructions stored in the memory and executable by the processor to instruct the system to:

during pumping of fluid into a borehole via a conduit in fluid communication with an annulus, defined in part by the conduit and defined in part by a formation that defines the borehole, to advance flow of cement in the annulus, receive sensor-based measurements;

based on at least a portion of the measurements, determine an effective density exerted by at least the cement against the formation;

perform an effective density comparison between a predetermined effective density and the determined effective density;

determine a pressure profile with respect to depth based at least in part on the effective density;

perform a pressure comparison of at least one warning pressure to the pressure profile; and based on the pressure comparison or the effective density comparison, issue a notification.

* * * * *